US009146488B2

(12) United States Patent
Yamada et al.

(10) Patent No.: US 9,146,488 B2
(45) **Date of Patent: *Sep. 29, 2015**

(54) LIQUID DEVELOPER

(71) Applicant: Konica Minolta, Inc., Chiyoda-ku (JP)

(72) Inventors: Chiaki Yamada, Ibaraki (JP); Masahiro Anno, Sakai (JP); Sho Kim, Kyoto (JP); Yukiko Uno, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/073,994

(22) Filed: Nov. 7, 2013

(65) Prior Publication Data

US 2014/0134536 A1 May 15, 2014

(30) Foreign Application Priority Data

Nov. 15, 2012 (JP) ..... 2012-251385

(51) Int. Cl.
*G03G 9/00* (2006.01)
*G03G 9/12* (2006.01)
*G03G 9/13* (2006.01)

(52) U.S. Cl.
CPC ..... *G03G 9/122* (2013.01); *G03G 9/132* (2013.01)

(58) Field of Classification Search
CPC ..... G03G 9/122
USPC ..... 430/114
See application file for complete search history.

(56) References Cited

U.S. PATENT DOCUMENTS

| | | | |
|---|---|---|---|
| 4,147,812 | A | 4/1979 | De Volder et al. |
| 5,529,874 | A | 6/1996 | Kobayashi et al. |
| 5,547,804 | A | 8/1996 | Nishizawa et al. |
| 6,120,957 | A | 9/2000 | Miyamoto et al. |
| 2007/0279467 | A1 | 12/2007 | Regan et al. |
| 2008/0003516 | A1 | 1/2008 | Akioka et al. |
| 2014/0134537 | A1 | 5/2014 | Yamada et al. |

FOREIGN PATENT DOCUMENTS

| | | | |
|---|---|---|---|
| JP | 52-037435 | A | 3/1977 |
| JP | 6-317938 | A | 11/1994 |
| JP | 09-269615 | A | 10/1997 |
| JP | 11-293144 | A | 10/1999 |
| JP | 2008-203372 | A | 9/2008 |
| JP | 2009-133973 | A | 6/2009 |
| JP | 2011-100000 | A | 5/2011 |

*Primary Examiner* — Mark A Chapman
(74) *Attorney, Agent, or Firm* — Buchanan Ingersoll & Rooney PC

(57) ABSTRACT

A liquid developer includes toner particles and an insulating liquid, the toner particles include a resin and a pigment, the resin includes a crystalline resin, the pigment includes a first pigment, a second pigment, and a third pigment, the first pigment is carbon black, the second pigment is C.I. Pigment Brown 23 and/or C.I. Pigment Brown 25, the third pigment is nigrosine, and 20 to 60% by mass of the pigment is included relative to the toner particles.

4 Claims, 1 Drawing Sheet

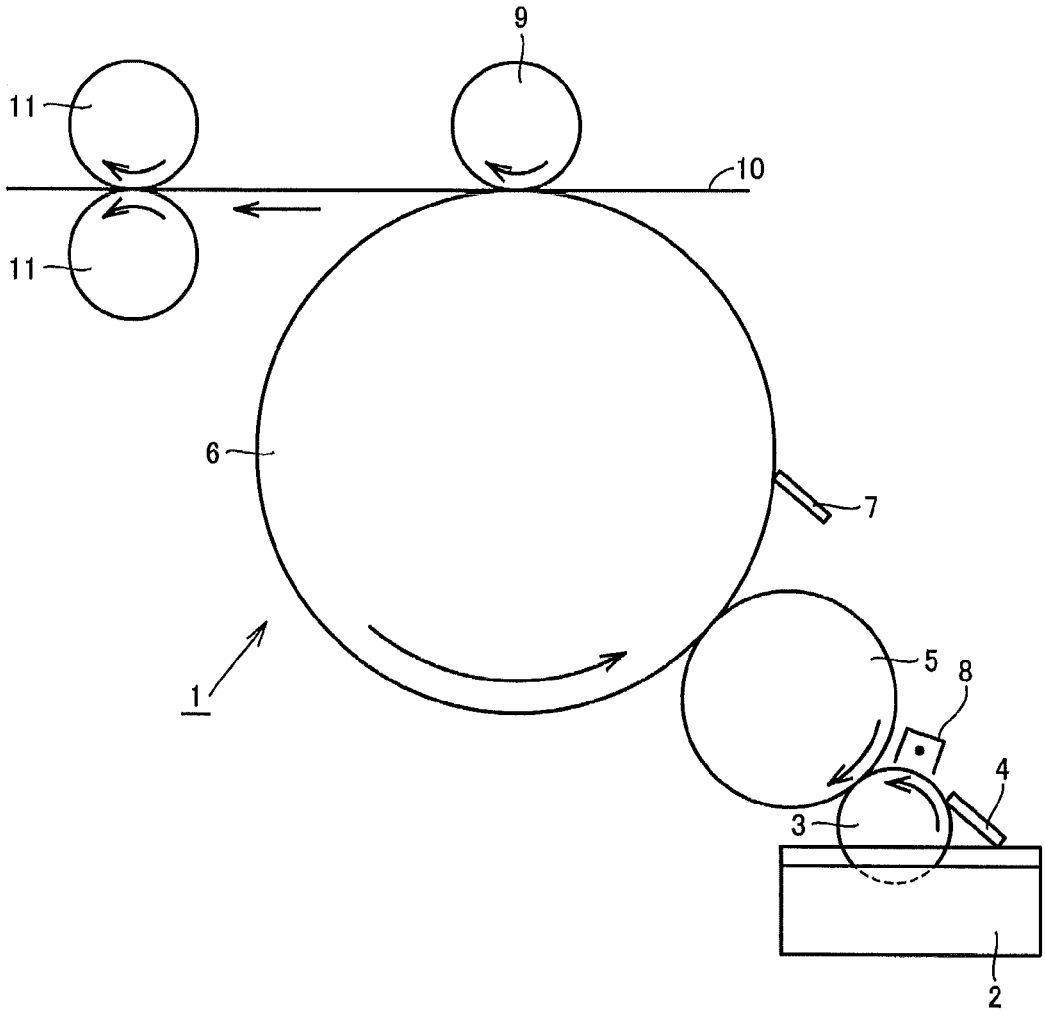
9
11
10
11
6
7
1
5
8
4
3
2

LIQUID DEVELOPER

This application is based on Japanese Patent Application No. 2012-251385 filed with the Japan Patent Office on Nov. 15, 2012, the entire content of which is hereby incorporated by reference.

BACKGROUND OF THE INVENTION

1. Field of the Invention

The present invention relates to a liquid developer.

2. Description of the Related Art

In a liquid developer used for an electrophotographic image forming apparatus, carbon black is widely used as a pigment (coloring material) for obtaining a black image.

For example, Japanese Laid-Open Patent Publication No. 52-037435 (hereinafter "Patent Document 1") discloses that carbon black and copper phthalocyanine are mixed for adjusting the tone of black.

In addition, Japanese Laid-Open Patent Publication No. 09-269615 (hereinafter "Patent Document 2") discloses that two or more types of coloring agents are used in combination in order to improve various physical properties.

Moreover, Japanese Laid-Open Patent Publication No. 2009-133973 (hereinafter "Patent Document 3") discloses that a nigrosine-based dye is used as a charge control agent, in combination with carbon black.

SUMMARY OF THE INVENTION

In recent years, there has been a demand for a heat-resistant storage property of a liquid developer (also called wet developer) used for an electrophotographic image forming apparatus. In order to meet this demand, the following design has been made. Specifically, in consideration of the fact that a resin included in toner particles is plasticized in an insulating liquid which is a component of the liquid developer, the glass transition point (Tg) of the resin itself is designed to be a high temperature so that, even when the resin is in the plasticized state, the glass transition point of the resin is kept equal to or higher than a storage temperature. When Tg of the resin is raised, however, a greater amount of thermal energy is accordingly required for fixation of an image by the image forming apparatus and thus increase of the fixing temperature is required.

Use of a crystalline resin as the aforementioned resin allows both the heat-resistant storage property and a good fixation quality to be expected. The crystalline resin has a sharp melt property and therefore keeps high viscoelasticity at a temperature in a range lower than the melting point. However, at the melting point, the viscoelasticity sharply drops, which makes it possible to accomplish fixation at a relatively low fixing temperature and also makes it possible to produce an image which is excellent in fixation strength. Thus, there is a demand for use of a crystalline resin as the resin which is a component of the toner particles.

A liquid developer has a feature that the particle size of its toner particles is smaller than that of a dry developer for the sake of high image quality, safety, and the like. The toner particles included in this liquid developer include a resin and a pigment as its main components. In order to ensure an adequate image density on a recording medium, it is necessary to increase the ratio of the pigment as the particle size of the toner particles is smaller.

Thus, in the liquid developer used for obtaining a black image, the ratio of a black pigment included in the toner particles should be 20% by mass or more in order to ensure an adequate image density. Meanwhile, in order to meet the recent demands for high image quality and low cost, it is necessary to reduce the amount of toner particles adhering onto a recording medium such as paper. It is therefore desired to increase the ratio of the black pigment included in the toner particles, in order to achieve both an adequate image density and a smaller amount of toner particles adhering onto a recording medium.

Carbon black used commonly as this black pigment, however, has electrical conductivity, which means that an increase of the concentration of carbon black causes the electrical resistance of the toner particles to decrease, resulting in a problem of occurrence of a transfer failure in electrophotographic image formation.

To this problem of transfer failure, a solution may be use of nigrosine which performs a function of adjusting charge as proposed in Patent Document 3, for example. However, in the case where a higher concentration of carbon black is used, the amount of nigrosine has to be increased accordingly.

In the case where a crystalline resin is used as described above as the resin which is a component of the toner particles, an increased amount of nigrosine causes a problem that the viscoelasticity increases. Therefore, addition of nigrosine has not enabled the problem of transfer failure to be solved adequately.

Use of carbon black and copper phthalocyanine in combination as disclosed in Patent Document 1 is not an effective solution to the transfer failure, since copper phthalocyanine itself is electrically conductive. Although Patent Document 2 discloses that carbon black and Solvent Brown 58 are used in combination, Solvent Brown 58 migrates into the insulating liquid which is included in the liquid developer and in which toner particles are dispersed, resulting in a problem of occurrence of a transfer failure.

The present invention has been made in view of the above circumstances, and an object of the present invention is to provide a liquid developer that not only satisfies an adequate image density and a proper hue but also prevents the problem of transfer failure regardless of use of a crystalline resin as the resin included in toner particles, and further has a good fixation strength given by the use of the crystalline resin.

The inventors of the present invention have conducted thorough studies for the purpose of solving the above problem to accordingly find that it is most effective to use, in combination with carbon black, a pigment capable of keeping a hue of black without deteriorating the transfer quality and without causing increase of the viscoelasticity of the crystalline resin, and have conducted further studies based on this finding to eventually achieve the present invention.

Specifically, a liquid developer of the present invention is characterized in that the liquid developer includes toner particles and an insulating liquid, the toner particles include a resin and a pigment, the resin includes a crystalline resin, the pigment includes a first pigment, a second pigment, and a third pigment, the first pigment is carbon black, the second pigment is C.I. (color index) Pigment Brown 23 and/or C.I. Pigment Brown 25, the third pigment is nigrosine, and 20 to 60% by mass of the pigment is included relative to the toner particles.

Here, it is preferable that the pigment further includes a fourth pigment and/or a fifth pigment, the fourth pigment is C.I. Pigment Blue 15:3 and/or C.I. Pigment Blue 15:4, the fifth pigment is at least one type of yellow pigment selected from the group consisting of C.I. Pigment Yellow 74, C.I. Pigment Yellow 155, C.I. Pigment Yellow 180, and C.I. Pigment Yellow 185, and 20 to 60% by mass of the pigment is included relative to the toner particles.

It is also preferable that 30 to 50% by mass of the first pigment is included relative to a total amount of the pigment, 30 to 50% by mass of the second pigment is included relative to the total amount of the pigment, and 15 to 30% by mass of the third pigment is included relative to the total amount of the pigment.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic conceptual diagram of an electrophotographic image forming apparatus.

DESCRIPTION OF THE PREFERRED EMBODIMENTS

In the following, an embodiment of the present invention will be described in further detail.

<Liquid Developer>

A liquid developer of the present embodiment includes at least toner particles and an insulating liquid, and the toner particles are dispersed in the insulating liquid. As long as this liquid developer includes these components, the liquid developer may include other arbitrary components. Examples of other components may be toner dispersant (toner dispersant is distinguished from a pigment dispersant included in toner particles as described later herein, in that the toner dispersant is included in the insulating liquid for dispersing the toner particles, and will be referred to in the present embodiment as "toner dispersant" for the sake of convenience), charge control agent, thickener, and the like.

The ratio between the contents of the components of the liquid developer may for example be 1 to 50% by mass of the toner particles and the remainder of the insulating liquid and arbitrary components. If the content of the toner particles is less than 1% by mass, the toner particles are likely to settle, and the stability with time during a long-term storage tends to deteriorate. Moreover, in order to obtain a required image density, a large amount of the liquid developer must be fed and accordingly the amount of the insulating liquid adhering to a recording medium such as paper increases. In this case, the need arises to dry the insulating liquid in the fixing process and resultant vapor could cause an environmental problem. On the contrary, if the content of the toner particles is more than 50% by mass, the liquid developer has an excessively high viscosity. Such a liquid developer tends to difficult to manufacture and handle.

The viscosity of the liquid developer at 25° C. is preferably not less than 0.1 mPa·s and not more than 10000 mPa·s. If the viscosity is higher than 10000 mPa·s, the liquid developer is difficult to stir. In this case, the toner particles cannot uniformly be dispersed in the insulating liquid and a heavy burden may be imposed on an apparatus which is used for obtaining the liquid developer. On the contrary, if the viscosity is lower than 0.1 mPa·s, the toner particles are likely to settle, the stability with time during a long-term storage may deteriorate, and the image density may be unstable.

The liquid developer as described above is useful as a black developer (namely a developer used for forming a black image) adapted to an electrophotographic image forming apparatus, and has excellent effects that the present liquid developer not only satisfies an adequate image density and a proper hue but also prevents the problem of transfer failure and is further excellent in fixation strength. Moreover, this liquid developer has an advantage that it can provide an image of high quality and achieve low cost.

In other words, the liquid developer of the present embodiment has the excellent effects that it satisfies an adequate image density and a proper hue and prevents the problem of transfer failure regardless of use of a crystalline resin as the resin included in toner particles as described later herein, and is also excellent in fixation strength.

<Toner Particles>

The toner particles included in the liquid developer of the present embodiment include a resin and a pigment. As long as the above toner particles include a resin and a pigment, they may include other arbitrary components. Examples of other components may be pigment dispersant, wax, charge control agent, other coloring agents (except for first pigment, second pigment, third pigment, fourth pigment, and fifth pigment described later herein), and the like.

The above toner particles have an average particle size of preferably 0.1 to 5 μm, and more preferably 0.5 to 3 μm. It should be noted that the average particle size is herein a volume-average particle size. In the following, each of the components constituting the toner particles will be described.

<Pigment>

The pigment included in the toner particles of the present embodiment is characterized in that the pigment includes a first pigment, a second pigment, and a third pigment, the first pigment is carbon black, the second pigment is C.I. Pigment Brown 23 and/or C.I. Pigment Brown 25, the third pigment is nigrosine, and 20 to 60% by mass (not less than 20% by mass and not more than 60% by mass) of the pigment is included relative to the toner particles.

It should be noted that in the case where the simple term "pigment" is used herein for the present invention, this term is an inclusive term (representing all pigment components included in the toner particles) encompassing the first, second, and third pigments (or fourth and fifth pigments described later herein).

Thus, the pigment of the present embodiment includes carbon black which is the first pigment, a specific brown pigment which is the second pigment, and nigrosine which is the third pigment to thereby exhibit the excellent effects that no transfer failure occurs even if the concentration of the pigment in the toner particles is considerably high, and that the viscoelasticity of the crystalline resin is not caused to increase. More specifically, the concentration of the pigment (namely the total amount of pigment components including the first pigment, the second pigment, the third pigment, and the like) in the present embodiment may be a considerably high concentration of 20 to 60% by mass relative to the toner particles. Accordingly, a proper image density is achieved even when the amount of toner particles adhering onto a recording medium such as paper is a small amount of about 3.0 g/m$^2$ or less. In addition, the pigment has a feature that it can exhibit a considerably suitable hue of black with good color reproducibility and still causes no transfer failure, and also has a feature that the viscoelasticity of the crystalline resin is not caused to increase.

In contrast, in the case where only carbon black is used as the pigment and the concentration of carbon black in the toner particles is a high concentration of 20% by mass or more, the chargeability of the toner particles is deteriorated due to the low electrical resistance of carbon black and accordingly a transfer failure occurs. In particular, under high-temperature and high-humidity conditions for example, the influence of the moisture in the air makes it difficult to keep a stable charge amount, which results in a problem that development failure, transfer failure, fog, or the like occurs and non-uniformity of the image and/or low image density are/is also caused.

Use of only carbon black and nigrosine in combination as the pigment as disclosed in Patent Document 3 can increase the electrical resistance and thus the problem of transfer failure can be solved to a certain extent. However, the viscoelasticity of the crystalline resin increases as described above and accordingly the fixation quality of the image forming apparatus is deteriorated.

In the case where only carbon black and a specific brown pigment which is the second pigment are used in combination and respective contents are high, the dispersibility of the pigment in the crystalline resin is deteriorated and both the transfer quality and the fixation quality are degraded.

In the case where carbon black, nigrosine, and copper phthalocyanine are used in combination as the pigment, the problems about the transfer quality and the increased viscoelasticity of the crystalline resin can be solved to a certain extent. However, a proper black hue cannot be accomplished.

In view of the above, in order to satisfy an adequate image density and a proper hue and also prevent the problem of transfer failure and further suppress increase of the viscoelasticity of the crystalline resin, it is requisite to use a specific brown pigment(s) such as C.I. Pigment Brown 23 and/or C.I. Pigment Brown 25 which are/is the second pigment as well as nigrosine which is the third pigment, in combination with carbon black which is the first pigment. This specific brown pigment has a considerably strong tinting power, has a hue close to black, and has a high electrical resistance, and does not migrate into the insulating liquid. This brown pigment is therefore considered as exhibiting the above excellent effects. However, in the crystalline resin, the dispersibility of the brown pigment as well as that of carbon black are insufficient, and thus the transfer quality and the fixation quality are degraded. Then, nigrosine, which is the third pigment, is used in combination with them to thereby provide considerably excellent dispersibility of these pigments and thus produce the excellent effects as described above, and is therefore one of the most significant features of the present invention.

It should be noted that the above pigment of the present embodiment is dispersed in the resin in the toner particles and provides a desired black tone. This pigment has a particle size of preferably 0.5 μm or less, and more preferably 0.15 μm or less. If the particle size of the pigment is larger than 0.5 μm, deviation of the color value of the image occurs and thus a desired color may not be achieved. In addition, due to low dispersibility of the pigment, a desired image density may not be achieved. The lower limit of the particle size of the pigment is not particularly limited.

The total mass of the pigment is 20 to 60% by mass relative to the toner particles as described above. If it is less than 20% by mass and the amount of toner particles adhering onto a recording medium such as paper is a small amount of about 3.0 g/m$^2$ or less, a proper image density cannot be achieved. If it is more than 60% by mass, the content of the resin relative to the toner particles is accordingly lower and therefore an adequate fixation strength cannot be achieved. In addition, the uniform dispersibility of the pigment in the resin is deteriorated and therefore the hue is degraded. Moreover, the deteriorated uniform dispersibility of carbon black causes the charge holding property to be lowered and the transfer quality to be degraded. The total mass of the pigment is more preferably 25 to 40% by mass.

It should be noted that the pigment of the present embodiment may include not only those commonly recognized as a pigment, but also those classified as a dye, and is more specifically those having a solubility of 0 to 0.5 g at 25° C. relative to 100 g of the insulating liquid which is a constituent of the liquid developer including the pigment. In addition, the above-referenced particle size of the pigment is the volume-average particle size.

In the following, each pigment will be described in further detail.

<First Pigment>

The first pigment is carbon black. Carbon black has a strong tinting power and is therefore necessary for achieving a desired black image density.

Preferably, 30 to 50% by mass of the above first pigment is included relative to the total amount of the pigment in the toner particles. If the content of the first pigment is less than 30% by mass, there is a tendency that the image density decreases. If the content thereof is more than 50% by mass, there is a tendency that adjustment of the electrical resistance of the toner particles is difficult, and therefore the transfer quality is degraded. The content is more preferably 33 to 47% by mass, and still more preferably 35 to 45% by mass.

In the present embodiment, the reason why such a high concentration of carbon black can be included is that a specific brown pigment which is the second pigment as well nigrosine which is the third pigment are added together with the carbon black into the toner particles, which is a significant feature of the present embodiment.

Here, carbon black is a collective term for black fine particles in which carbon is its main component. While carbon black is chemically classified as a sole carbon in some cases, carbon black may include a variety of functional groups as is well known. The type of this carbon black is not particularly limited, and examples of carbon black may be thermal black, acetylene black, channel black, furnace black, lamp black, aniline black, and the like.

It should be noted that the above carbon black may undergo a surface treatment so that its surface properties are altered as required.

As the method for this treatment, any of a variety of conventionally known methods may be employed. Preferably, examples of the method may be a wet surface treatment method according to which carbon black is immersed in an acid solution such as acetic acid solution, sulfonic acid solution, or the like, and a dry surface treatment method using no liquid. Examples of the dry surface treatment method may be a method according to which carbon black is brought into contact with a gas mixture of nitric acid/nitrogen oxide and air, or oxidizer such as ozone, and the air oxidation method. Some commercially available carbon blacks on the market have their pH adjusted already.

Preferred specific examples of carbon black in the present embodiment are "#2400," "#2400B," "#2650," "OIL7B," "MA77," "MA100," "MA100S," and "PCF#10" manufactured by Mitsubishi Chemical Corporation, "Black Pearls L," "Mogul L," "MONARCH 1300," "MONARCH 1400," "REGAL 330R," "REGAL 400R," and "MONARCH 1100" manufactured by Cabot Corporation, "Printex V," "Special Black 4," and "Printex 140V" manufactured by Degussa, and the like (the above terms between the double quotation marks are trademarks).

As the first pigment of the present embodiment, one or two or more types of carbon black may be used. In the case where two or more types of carbon black are used, it is preferable that the total amount of them falls in the above-described range.

<Second Pigment>

The second pigment is C.I. Pigment Brown 23 and/or C.I. Pigment Brown 25. The second pigment is thus a brown pigment indicated by a specific color index name. This brown pigment has a considerably strong tinting power, has its hue close to that of black, has a high electrical resistance, does not migrate into the insulating liquid unlike other brown-based coloring agents, and is therefore used together with the third pigment described later herein and with the carbon black to exhibit the excellent effects as described above. Namely, even when a high concentration of the brown pigment relative to the carbon black is included for the sake of adjusting the electrical resistance, the image density does not decrease and/or the hue is not changed. Therefore, the electrical resistance can sufficiently be adjusted and accordingly there are exhibited the excellent effects that not only an adequate image density and a proper hue are satisfied but also the problem of transfer failure can be prevented.

The content of this second pigment relative to the total amount of the pigment is preferably 30 to 50% by mass, and more preferably 35 to 45% by mass. If the content of the second pigment is less than 30% by mass, adjustment of the electrical resistance of the toner particles is insufficient, resulting in a tendency that the transfer quality is deteriorated. If the content of the second pigment is more than 50% by mass, the image density is insufficient and the hue of the toner particles is closer to the hue of the brown pigment, resulting in a tendency that a desired black hue cannot be achieved. It should be noted that in the case where two types of brown pigments are used as the second pigment, the total amount of the brown pigments is preferably set within the above-described range.

As this brown pigment, any of the following commercially available pigments may be used, for example. Namely, examples of the brown pigment may be "PV Fast Brown HFR" (trademark of C.I. Pigment Brown 25, manufactured by Clariant Japan K.K.), "Cromophtal (registered trademark) Brown 5R" (trademark of C.I. Pigment Brown 23, manufactured by BASF), and the like.

<Third Pigment>

The third pigment is nigrosine. The third pigment performs a unique function of improving the dispersibility of the above-described first and second pigments in the crystalline resin. Therefore, this third pigment can be used in combination with the first and second pigments to thereby very effectively solve the problem of transfer failure and fixation failure due to dispersion failure of the first and second pigments in the crystalline resin. Accordingly, the advantageous functions of the second pigment as described above can sufficiently be derived. In other words, the second pigment and the third pigment can be used in combination with carbon black which is the first pigment to thereby produce the significantly excellent effects that an adequate image density and a proper hue are satisfied and the problem of transfer failure can still be prevented regardless of use of a crystalline resin as the resin which is a component of the toner particles. In addition, a good fixation strength can be provided by the use of the crystalline resin.

The third pigment itself has a high electrical resistance as is clearly seen from the fact that the third pigment is also used as a charge control agent, and the third pigment is further excellent in terms of the hue and the tinting power. Therefore, use of the third pigment in combination with carbon black which is the first pigment allows an expectation that the problem of transfer failure is solved, however, there still remains an inconvenience that the viscoelasticity of the crystalline resin is considerably increased unless the second pigment is used in combination with the third pigment. In this respect as well, the second and third pigment used in combination have a reciprocal relationship therebetween.

The content of this third pigment relative to the total amount of the pigment is preferably 15 to 30% by mass, and more preferably 15 to 20% by mass. If the content of the third pigment is less than 15% by mass, dispersion failure of the first and second pigment may not sufficiently be improved. If the content of the third pigment is more than 30% by mass, the fixation quality may be deteriorated.

Here, nigrosine is a mixture of different types of azine-based compounds that can be produced through oxidation-reduction condensation of aniline, aniline hydrochloride, and nitrobenzene in the presence of catalyst such as iron chloride, and a main component of nigrosine is an azine-based compound which is a purple black dye having phenazine, phenazineazine, triphenazine oxazine or the like as its skeleton.

Examples of this nigrosine may be C.I. Solvent Black 7, C.I. Solvent Black 5, a variety of azine-based compounds, and the like.

Examples of the above C.I. Solvent Black 5 may be commercially available ones having trademarks such as "Spirit Black SB," "Spirit Black SSBB," "Spirit Black AB," "Spirit Black ABL," "NUBIAN BLACK NH-805," and "NUBIAN BLACK NH-815" manufactured by Orient Chemical Industries Co., Ltd.

Examples of the above C.I. Solvent Black 7 may be commercially available ones having trademarks such as "Nigrosine Base SA," "Nigrosine Base SAP," "Nigrosine Base SAPL," "Nigrosine Base EE," "Nigrosine Base EEL," "Nigrosine Base EX," "Nigrosine Base EXBP," "Special Black EB," "NUBIAN BLACK TN-870," "NUBIAN BLACK TN-877," "NUBIAN BLACK TH-807," "NUBIAN BLACK TH-827," and "NUBIAN GREY IR-B" manufactured by Orient Chemical Industries Co., Ltd.

Examples of the above azine-based compounds may be commercially available ones having trademarks such as "BONTRON N-01," "BONTRON N-04," "BONTRON N-07," "BONTRON N-09," "BONTRON N-21," "BONTRON N-71," "BONTRON N-75," and "BONTRON N-79" manufactured by Orient Chemical Industries Co., Ltd.

As the third pigment of the present embodiment, one or two or more types of nigrosine may be used. In the case where two or more types of nigrosine are used, it is preferable that the total amount of them falls in the above-described range.

<Contents of First, Second, and Third Pigments>

The liquid developer of the present embodiment preferably includes 30 to 50% by mass of the first pigment relative to the total amount of the pigment, 30 to 50% by mass of the second pigment relative to the total amount of the pigment, and 15 to 30% by mass of the third pigment relative to the total amount of the pigment, as described above. Accordingly, the excellent effects can more effectively be exhibited, namely the effects that an adequate image density and a proper hue are satisfied, the problem of transfer failure is prevented, and an excellent fixation strength is achieved.

It should be noted that the upper limit of the total amount of the first, second, and third pigments in this case is 100% by mass relative to the total amount of the pigment, and the pigment may be constituted solely of the first pigment, the second pigment, and the third pigment. This pigment may also include, together with the first, second, and third pigments, the fourth pigment and/or the fifth pigment as described below.

<Fourth Pigment>

The fourth pigment is C.I. Pigment Blue 15:3 and/or C.I. Pigment Blue 15:4. Thus, the fourth pigment is a cyan pigment indicated by a specific color index name. This cyan pigment can be used mainly for the purpose of adjusting the hue.

The content of this fourth pigment relative to the total amount of the pigment is preferably 1 to 10% by mass, and more preferably 3 to 7% by mass. If the content of the fourth pigment is less than 1% by mass, there is a tendency that adjustment of the hue is not optimum (due to an insufficient amount of cyan, the resultant color is relatively reddish). If the content of the fourth pigment is more than 10% by mass as well, there is a tendency that adjustment of the hue is not optimum (due to an excessive amount of cyan, the resultant color is relatively bluish). In the case where two types of cyan pigments are used as the fourth pigment, it is preferable that the total amount of these pigments is set within the above-described range.

As this cyan pigment, any of the following commercially available pigments may be used, for example. Namely, examples of the cyan pigment may be "Fastogen Blue GNPT" (trademark of C.I. Pigment Blue 15:3, manufactured by DIC), as well as "cyanine blue 4933GN-EP," "cyanine blue 4940," and "cyanine blue 4973" (manufactured by Dainichiseika Color & Chemicals Mfg. Co., Ltd.), and "Fastogen Blue GNPS-G" (manufactured by DIC) (the above are trademarks of C.I. Pigment Blue 15:4), and the like.

<Fifth Pigment>

The fifth pigment is at least one type of yellow pigment selected from the group consisting of C.I. Pigment Yellow 74, C.I. Pigment Yellow 155, C.I. Pigment Yellow 180, and C.I. Pigment Yellow 185. Thus, the fifth pigment is a yellow pigment indicated by a specific color index name. This yellow pigment can be used mainly for the purpose of adjusting the hue.

The content of this fifth pigment relative to the total amount of the pigment is preferably 1 to 10% by mass, and more preferably 3 to 7% by mass. If the content of the fifth pigment is less than 1% by mass, there is a tendency that adjustment of the hue is not optimum. If the content thereof is more than 10% by mass, the ratio of the yellow pigment to the whole pigment is excessive, resulting in a tendency that a desired image density (ID) cannot be achieved. In the case where two or more types of the yellow pigments are used as the fifth pigment, preferably the total amount of these pigments is set within the above-described range.

As this yellow pigment, any of the following commercially available pigments may be used, for example. Namely, examples of the yellow pigment may be "Seikafast Yellow 2054" (trademark of C.I. Pigment Yellow 74, manufactured by Dainichiseika Color & Chemicals Mfg. Co., Ltd.), "Graphtol Yellow 3GP" (trademark of C.I. Pigment Yellow 155, manufactured by Clariant Japan K.K.), "Toner Yellow HG" (trademark of C.I. Pigment Yellow 180, manufactured by Clariant Japan K.K.), "PALIOTOL YELLOW D 1155" (trademark of C.I. Pigment Yellow 185, manufactured by BASF), and the like.

It should be noted that in the case where the fourth pigment and/or the fifth pigment as described above are/is included as the pigment, the total content of the pigment may also be 20 to 60% by mass relative to the toner particles.

<As to Hue>

Usually, the hue can be represented by respective values of the L* axis, the a* axis, and the b* axis of the uniform color space of the L*a*b* color system defined under JIS Z 8729. An ideal hue of a black image may be the hue (paper type: coated paper, type: black-dot area ratio 100% portion) defined under the sheet-fed offset printing color standards Japan Color for Color Reproduction Printing 2001.

Generally, an allowable color difference is defined as $\Delta E<6$, which is more preferably $\Delta E<3$. It should be noted that $\Delta E$ is a color difference between a certain color and another color in the uniform color space of the L*a*b* color system defined under JIS Z 8729, and is represented by the square root of the sum of respective squares of respective differences in L* axis value, a* axis value, and b* axis value.

In the case where only the carbon black which is the first pigment is used as the pigment, the color difference meets $\Delta E<6$ and thus the hue is proper. When only the second and third pigments are added together with the carbon black, the influence of the hue of the second and third pigments may make it impossible to meet $\Delta E<6$. In such a case, it is preferable to add the above fourth pigment and/or fifth pigment to make it possible to meet $\Delta E<6$.

<Resin>

The resin included in the toner particles of the present embodiment includes a crystalline resin. Namely, the resin may be constituted of the crystalline resin only, or a part of the resin may be a resin other than the crystalline resin. In terms of the heat-resistant storage property and the quality of fixation by an image forming apparatus, the resin is preferably constituted of a crystalline resin only.

This crystalline resin may either be thermoplastic resin or thermosetting resin. The chemical composition thereof is not particularly limited, and examples thereof may be vinyl resin, polyester resin, polyurethane resin, epoxy resin, polyamide resin, polyimide resin, silicon resin, phenol resin, melamine resin, urea resin, aniline resin, ionomer resin, and polycarbonate resin, and the like. A single type of crystalline resin, or a combination of two or more types thereof may be used.

Of the above-listed resins, use of vinyl resin, polyester resin, polyurethane resin, or epoxy resin, or use of them in combination is preferred in terms of the fact that a non-aqueous resin particle dispersion is obtained relatively easily. More preferably, polyester resin or polyurethane resin or a combination of them is used.

Here, "crystalline resin" is a resin having a ratio (Tm/Ta) between the softening point (hereinafter also "Tm") and the maximum peak temperature of heat of fusion (hereinafter also "Ta") of 0.8 to 1.55, and exhibiting a clear endothermic peak rather than a stepwise change in endothermic quantity under differential scanning calorimetry (DSC). Tm and Ta can be measured in the following way.

Specifically, a Koka-type flow tester (trademark "CFT-500D," manufactured by Shimadzu Corporation, for example) is used to heat 1 g of a sample (crystalline resin) at a rate of 6° C./min while applying a load of 1.96 MPa by a plunger to push out the sample from a nozzle of 1 mm in diameter and 1 mm in length. Then, a graph of correlation between "plunger drop (flow value)" and "temperature" is prepared. From the graph, the temperature corresponding to a half of the maximum value of the plunger drop is read, and this temperature (temperature (° C.) when a half of the sample has flown out) is Tm.

Ta is measured by means of a differential scanning calorimeter (trademark "DSC210," manufactured by Seiko Electronics Industrial Co., Ltd., for example). A sample (crystalline resin) whose Ta is to be measured is subjected to a pretreatment of being melted at 130° C., thereafter reduced in temperature at a rate of 1.0° C./min from 130° C. to 70° C., and then further reduced in temperature at a rate of 0.5° C./min from 70° C. to 10° C. Subsequently, the sample is heated at a rate of 20° C./min to thereby measure an endothermic/exothermic change and accordingly prepare a graph of correlation between "endothermic/exothermic amount" and "temperature." The endothermic peak temperature as observed to be within a range of 20 to 100° C. is Ta'. If there are more than one endothermic peak, the peak temperature of maximum endothermic quantity is Ta'. Subsequently, the sample is stored at (Ta'−10)° C. for six hours, and thereafter stored at (Ta'−15)° C. for six hours.

Subsequently, the sample is cooled at a rate of 10° C./min to 0° C. by means of the differential scanning calorimeter, and thereafter heated at a rate of 20° C./min to measure an endothermic/exothermic change and accordingly prepare a similar graph of correlation. Then, the temperature (° C.) corresponding to the peak of the maximum endothermic quantity is Ta.

It should be noted that a resin of a core-shell type structure may also be used as the resin of the present embodiment.

<Pigment Dispersant>

The toner particles of the present embodiment may include a pigment dispersant for the sake of uniformly dispersing the pigment. In order to stably and uniformly disperse the pigment in the toner particles, a basic pigment dispersant is preferably used as the pigment dispersant. As long as the pigment dispersant is such a basic pigment dispersant, the type of the pigment dispersant is not particularly limited.

Here, the basic pigment dispersant is the one defined as follows. Specifically, 0.5 g of a pigment dispersant and 20 ml of distilled water are placed in a glass screw tube, shook with a paint shaker for 30 minutes, and thereafter filtered. The pH of the resultant filtrate is measured with a pH meter (trademark: "D-51" manufactured by HORIBA, Ltd.). When the filtrate has a pH larger than 7, it is regarded as a basic pigment dispersant. If the filtrate has a pH smaller than 7, it is called acid pigment dispersant.

The type of this basic pigment dispersant is not particularly limited. For example, the basic dispersant may be a compound (dispersant) having, in its molecule, a functional group such as amine group, amino group, amide group, pyrrolidone group, imine group, imino group, urethane group, quaternary ammonium group, ammonium group, pyridino group, pyridium group, imidazolino group, imidazolium group, or the like. It should be noted that the dispersant is usually a so-called interface-active agent having in its molecule a hydrophilic portion and a hydrophobic portion. A variety of compounds may be used as the pigment dispersant as long as they perform a function of dispersing the pigment.

Commercially available products of such a basic pigment dispersant may for example be "Ajisper PB-821" (trademark), "Ajisper PB-822" (trademark), and "Ajisper PB-881" (trademark) manufactured by Ajinomoto Fine-Techno Co., Inc., "Solsperse 28000" (trademark), "Solsperse 32000" (trademark), "Solsperse 32500" (trademark), "Solsperse 35100" (trademark), and "Solsperse 37500" (trademark) manufactured by Lubrizol Japan Limited, and the like.

The amount of this pigment dispersant as added is preferably 1 to 100% by mass relative to the pigment. It is more preferably 1 to 40% by mass. If the amount of the pigment dispersant is less than 1% by mass, the dispersibility of the pigment may be inadequate, and accordingly a required ID (image density) may not be achieved and the transfer quality and the fixation strength may be decreased. If the amount of the pigment dispersant is more than 100% by mass, the pigment dispersant of an amount larger than the amount required for dispersion of the pigment is added, and accordingly an extra amount of the pigment dispersant may be dissolved in the insulating liquid, which may adversely affect the chargeability and the fixation strength of the toner particles.

One type of the pigment dispersant or a combination of two or more types thereof may be used.

<Insulating Liquid>

It is preferable that the insulating liquid included in the liquid developer of the present embodiment has an electrical resistance (on the order of $10^{11}$ to $10^{16}$ Ω·cm) to the extent that will not disturb an electrostatic latent image. It is also preferable that the insulating liquid has low odor and toxicity.

Examples of this insulating liquid may be aliphatic hydrocarbon, alicyclic hydrocarbon, aromatic hydrocarbon, halogenated hydrocarbon, polysiloxane, and the like. In particular, in terms of odor, harmlessness, and cost, normal paraffin-based solvent and isoparaffin-based solvent are preferred. More specific examples thereof may be Moresco White (trademark, manufactured by Matsumura Oil Research Corporation), Isopar (trademark, manufactured by Exxon Mobil Chemical), Shellsol (trademark, manufactured by Shell Chemicals), IP solvent 1620, IP solvent 2028, IP solvent 2835 (they are each trademark, manufactured by Idemitsu Chemicals), and the like.

<Toner Dispersant>

The liquid developer of the present embodiment may include a dispersant (toner dispersant) that is soluble in the insulating liquid, for the sake of stably dispersing the toner particles in the insulating liquid. The type of this toner dispersant is not particularly limited as long as the toner dispersant is capable of stably dispersing the toner particles. In the case where a polyester resin used as the resin included in the toner particles has a relatively high acid value, it is preferable to use a basic polymer dispersant.

The above toner dispersant may either be dissolved in the insulating liquid or dispersed in the insulating liquid. It is also preferable that 0.5 to 20% by mass of this toner dispersant is added relative to the toner particles. If the toner dispersant is less than 0.5% by mass, the dispersibility is deteriorated. If it is more than 20% by mass, the toner dispersant may take the insulating liquid therein to cause the fixation strength of the toner particles to decrease.

It should be noted that in the case where the above toner dispersant is adsorbed on the surface of the toner particles, the dispersant is regarded as a part of the toner particles. In this case, the mass of the toner particles include the mass of the dispersant.

<Method for Manufacture>

The liquid developer of the present embodiment may be manufactured based on a conventionally known method such as granulation method, pulverization method, or the like. The manufacturing method is not particularly limited. However, the granulation method is one of most appropriate manufacturing methods, since the granulation method provides a higher energy efficiency and a smaller number of manufacturing steps as compared with the pulverization method. Such a granulation method is an appropriate manufacturing method as well in terms of the fact that small-size toner particles with a uniform particle size distribution can easily be obtained.

Such a granulation method may more specifically be suspension polymerization method, emulsion polymerization method, particle coagulation method, a method that adds a poor solvent to a resin solution and precipitates the resin, spray drying, or the like. The polymerization method may be a method according to which water is used as a continuous phase and, after toner particles are prepared, the continuous phase is replaced with oil (insulating liquid), a method according to which toner particles are prepared by polymerization directly in the oil (insulating liquid), and the like.

EXAMPLES

In the following, the present invention will be described in further detail with reference to Examples. The present invention, however, is not limited to them. It should be noted that the term "parts" in the Examples means "parts by mass" unless otherwise noted.

<Synthesis of Crystalline Polyester Resin>

In a reaction container provided with a stirring device, a heating/cooling device, a thermometer, and a nitrogen feed pipe, 755 parts (6.4 parts by mole) of ethylene glycol, 295 parts (1.8 parts by mole) of sebacic acid, and 3 parts of tetrabutoxy titanate as a condensation catalyst were placed.

Then, after polycondensation under the atmospheric pressure at 240° C. for six hours, the internal pressure was reduced. At the time when the acid value had reached 1.0, the pressure was set back to the atmospheric pressure and the temperature was lowered to 180° C. Subsequently, 30 parts (0.1 parts by mole) of trimellitic anhydride was placed at 180° C. and reacted at this temperature for one hour, and accordingly a crystalline polyester resin was obtained.

The number-average molecular weight (Mn) of this crystalline polyester resin was measured and it was 2600. The acid value was 15 mgKOH/g, and Tm/Ta measured in accordance with the method as described above was 1.41, and a definite endothermic peak was indicated under DSC.

Example 1

220 parts of glass beads were added to: 250 parts of acetone; 54.8 parts of crystalline polyester resin (namely crystalline resin) as the resin included in the toner particles, 15.75 parts of carbon black (trademark: "Mogul L," manufactured by Cabot Corporation) as the first pigment; 10.5 parts of C.I. Pigment Brown 25 (trademark: "PV Fast Brown HFR," manufactured by Clariant Japan K.K.) as the second pigment; 5.25 parts of nigrosine (trademark: "TH-827," manufactured by Orient Chemical Industries Co., Ltd.) as the third pigment; 1.05 parts of C.I. Pigment Blue 15:3 (phthalocyanine blue pigment) (trademark: "Fastogen Blue GNPT," manufacture by DIC) as the fourth pigment; 2.45 parts of C.I. Pigment Yellow 180 (trademark: "Toner Yellow HG," manufactured by Clariant Japan K.K.) as the fifth pigment; and 4.2 parts of pigment dispersant (trademark: "Ajisper PB-822," manufactured by Ajinomoto Fine-Techno Co., Inc.). They were dispersed by means of a paint conditioner for three hours, and thereafter the glass beads were removed. Accordingly, a resin solution X in which the pigments were dispersed was produced.

Then, 6 parts of toner dispersant that was N-vinylpyrrolidone/alkylene copolymer (trademark: "Antaron V-216," manufactured by GAF/ISP Chemicals) were dissolved in 300 parts of insulating liquid (trademark: "IP Solvent 2028," manufactured by Idemitsu Chemicals). The resultant solution was added to the above-described resin solution X, a homogenizer was activated to disperse the resin solution X for 10 minutes, and accordingly a liquid developer precursor was produced.

Subsequently, an evaporator was used to remove the acetone from the liquid developer precursor, and it was stored in a constant-temperature bath of 50° C. for five hours. Accordingly, a liquid developer of the present invention including toner particles and the insulating liquid was produced. The toner particles (having their surfaces to which the toner dispersant was adsorbed) included the resin (crystalline polyester resin), the first pigment (45% by mass relative to the total amount of the pigments), the second pigment (30% by mass relative to the total amount of the pigments), the third pigment (15% by mass relative to the total amount of the pigments), and the fourth and fifth pigments (the total content of the pigments in the toner particles: 35% by mass), and had an average particle size of 2.3 μm. The viscosity of the liquid developer was 26 mPa·s.

The volume-average particle size of the toner particles was measured with a particle size distribution analyzer (trademark: "FPIA-3000S," manufactured by Malvern Instruments Ltd.) (the same is applied as well to the following).

The viscosity of the liquid developer was measured with a rotation-vibration-type viscometer (trademark: "Viscomate VM-10A," manufactured by TGK) (the same is applied as well to the following).

Examples 2-15 and Comparative Examples 1-4

Liquid developers were produced in a similar manner to Example 1 except that the first pigment, the second pigment, the third pigment, the fourth pigment, and the fifth pigment (and another pigment in some Examples) indicated in Table 1 below were used, and the amount of each pigment as added (the ratio of the added pigment) was the one indicated in Table 1. In all Examples and Comparative Examples, the total content of the pigments in the toner particles was 35% by mass, and the average particle size of the toner particles was approximately 2.3 μm. In addition, the viscosity of the liquid developer was 15 to 40 mPa·s.

TABLE 1

| | first pigment | second pigment | third pigment | fourth pigment | fifth pigment | another pigment |
|---|---|---|---|---|---|---|
| Example 1 | CB1(45) | BR1(30) | NS1(15) | C1(3) | Y1(7) | — |
| Example 2 | CB2(40) | BR1(42) | NS2(18) | — | — | — |
| Example 3 | CB1(30) | BR1(35) | NS2(30) | C1(5) | — | — |
| Example 4 | CB2(50) | BR2(30) | NS1(15) | — | Y1(5) | — |
| Example 5 | CB1(30) | BR1(50) | NS1(15) | C2(4) | Y2(1) | — |
| Example 6 | CB2(50) | BR1(30) | NS1(15) | C1(2) | Y3(3) | — |
| Example 7 | CB1(28) | BR1(40) | NS1(20) | C1(5) | Y1(7) | — |
| Example 8 | CB1(52) | BR1(10) | NS2(30) | C1(3) | Y2(5) | — |
| Example 9 | CB2(30) | BR2(49) | NS1(13) | C2(7) | Y1(1) | — |
| Example 10 | CB1(30) | BR1(32) | NS1(31) | C1(5) | Y4(2) | — |
| Example 11 | CB2(48) | BR1(27) | NS1(20) | C1(4) | Y2(1) | — |
| Example 12 | CB1(30) | BR1(52) | NS1(15) | C1(2) | Y2(1) | — |
| Example 13 | CB1(29) | BR2(58) | NS1(13) | — | — | — |
| Example 14 | CB2(53) | BR1(16) | NS2(31) | — | — | — |
| Example 15 | CB1(45) | BR1(28) | NS1(13) | C1(4) | Y1(7) | M1(3) |
| Example 16 | CB1(45) | BR1(30) | NS1(15) | C1(3) | Y1(7) | — |
| Example 17 | CB1(45) | BR1(30) | NS1(15) | C1(3) | Y1(7) | — |

TABLE 1-continued

| | first pigment | second pigment | third pigment | fourth pigment | fifth pigment | another pigment |
|---|---|---|---|---|---|---|
| Comparative Example 1 | CB1(100) | — | — | — | — | — |
| Comparative Example 2 | CB1(50) | — | NS1(50) | — | — | — |
| Comparative Example 3 | CB1(50) | BR1(50) | — | — | — | — |
| Comparative Example 4 | CB1(40) | — | NS2(20) | C1(40) | — | — |
| Comparative Example 5 | CB1(45) | BR1(30) | NS1(15) | C1(3) | Y1(7) | — |
| Comparative Example 6 | CB1(45) | BR1(30) | NS1(15) | C1(3) | Y1(7) | — |

The numerical value in the parentheses for each pigment represents the content (% by mass) relative to the total amount of the pigments.

What are represented by the symbols indicated in Table 1 are as follows.

CB1: carbon black (trademark: "Mogul L," manufactured by Cabot Corporation)

CB2: carbon black (trademark: "MA77," manufactured by Mitsubishi Chemical Corporation)

BR1: C.I. Pigment Brown 25 (trademark: "PV Fast Brown HFR," manufactured by Clariant Japan K.K.)

BR2: C.I. Pigment Brown 23 (trademark: "Cromophtal Brown 5R," manufactured by BASF)

NS1: nigrosine (trademark: "NUBIAN BLACK TH-827," manufactured by Orient Chemical Industries Co., Ltd.)

NS2: nigrosine (trademark: "BONTRON N-09," manufactured by Orient Chemical Industries Co., Ltd.)

C1: C.I. Pigment Blue 15:3 (trademark: "Fastogen Blue GNPT," manufactured by DIC)

C2: C.I. Pigment Blue 15:4 (trademark: "Fastogen Blue GNPS-G," manufactured by DIC)

Y1: C.I. Pigment Yellow 180 (trademark: "Toner Yellow HG," manufactured by Clariant Japan K.K.)

Y2: C.I. Pigment Yellow 185 (trademark: "PALIOTOL YELLOW D 1155," manufactured by BASF)

Y3: C.I. Pigment Yellow 74 (trademark: "Seikafast Yellow 2054," manufactured by Dainichiseika Color & Chemicals Mfg. Co., Ltd.)

Y4: C.I. Pigment Yellow 155 (trademark: "Toner Yellow 3GP," manufactured by Clariant Japan K.K.)

M1: C.I. Pigment Red 122 (trademark: "FASTOGEN Super Magenta RTS," manufactured by DIC)

It should be noted that the blank cells ("-") in Table 1 mean that the corresponding component is not included.

Example 16

A liquid developer (the total content of the pigments in the toner particles: 20% by mass) was produced in a similar manner to Example 1 except for the changes:

250 parts of acetone;

71.6 parts of crystalline polyester resin (namely crystalline resin);

9.0 parts of carbon black (trademark: "Mogul L," manufactured by Cabot Corporation) as the first pigment;

6.0 parts of C.I. Pigment Brown 25 (trademark: "PV Fast Brown HFR," manufactured by Clariant Japan K.K.) as the second pigment;

3.0 parts of nigrosine (trademark: "TH-827" manufactured by Orient Chemical Industries Col, Ltd.) as the third pigment;

0.6 parts of C.I. Pigment Blue 15:3 (phthalocyanine blue pigment) (trademark: "Fastogen Blue GNPT," manufacture by DIC) as the fourth pigment;

1.4 parts of C.I. Pigment Yellow 180 (trademark: "Toner Yellow HG," manufactured by Clariant Japan K.K.) as the fifth pigment;

2.4 parts of pigment dispersant (trademark: "Ajisper PB-822," manufactured by Ajinomoto Fine-Techno Co., Inc.); and 6 parts of N-vinylpyrrolidone/alkylene copolymer (trademark: "Antaron V-216," manufactured by GAF/ISP Chemicals) as the toner dispersant. The average particle size of the toner particles was approximately 2.3 μm as well. In addition, the viscosity of the liquid developer was 34 mPa·s.

Example 17

A liquid developer (the total content of the pigments in the toner particles: 60% by mass) was produced in a similar manner to Example 1 except for the changes:

250 parts of acetone;

26.8 parts of crystalline polyester resin (namely crystalline resin);

27.0 parts of carbon black (trademark: "Mogul L," manufactured by Cabot Corporation) as the first pigment;

18.0 parts of C.I. Pigment Brown 25 (trademark: "PV Fast Brown HER," manufactured by Clariant Japan K.K.) as the second pigment;

9.0 parts of nigrosine (trademark: "TH-827" manufactured by Orient Chemical Industries Col, Ltd.) as the third pigment;

1.8 parts of C.I. Pigment Blue 15:3 (phthalocyanine blue pigment) (trademark: "Fastogen Blue GNPT," manufacture by DIC) as the fourth pigment;

4.2 parts of C.I. Pigment Yellow 180 (trademark: "Toner Yellow HG," manufactured by Clariant Japan K.K.) as the fifth pigment;

7.2 parts of pigment dispersant (trademark: "Ajisper PB-822," manufactured by Ajinomoto Fine-Techno Co., Inc.); and 6 parts of N-vinylpyrrolidone/alkylene copolymer (trademark: "Antaron V-216," manufactured by GAF/ISP Chemicals) as the toner dispersant. The average particle size of the toner particles was approximately 2.3 μm as well. In addition, the viscosity of the liquid developer was 31 mPa·s.

Comparative Example 5

A liquid developer (the total content of the pigments in the toner particles: 15% by mass) was produced in a similar manner to Example 1 except for the changes:

250 parts of acetone;

77.2 parts of crystalline polyester resin (namely crystalline resin);

6.75 parts of carbon black (trademark: "Mogul L," manufactured by Cabot Corporation) as the first pigment;

4.5 parts of C.I. Pigment Brown 25 (trademark: "PV Fast Brown HFR," manufactured by Clariant Japan K.K.) as the second pigment;

2.25 parts of nigrosine (trademark: "TH-827" manufactured by Orient Chemical Industries Col, Ltd.) as the third pigment;

0.45 parts of C.I. Pigment Blue 15:3 (phthalocyanine blue pigment) (trademark: "Fastogen Blue GNPT," manufacture by DIC) as the fourth pigment;

1.05 parts of C.I. Pigment Yellow 180 (trademark: "Toner Yellow HG," manufactured by Clariant Japan K.K.) as the fifth pigment;

1.8 parts of pigment dispersant (trademark: "Ajisper PB-822," manufactured by Ajinomoto Fine-Techno Co., Inc.); and 6.0 parts of N-vinylpyrrolidone/alkylene copolymer (trademark: "Antaron V-216," manufactured by GAF/ISP Chemicals) as the toner dispersant. The average particle size of the toner particles was approximately 2.3 μm as well. In addition, the viscosity of the liquid developer was 27 mPa·s.

Comparative Example 6

A liquid developer (the total content of the pigments in the toner particles: 65% by mass) was produced in a similar manner to Example 1 except for the changes:

250 parts of acetone;

21.2 parts of crystalline polyester resin (crystalline resin);

29.25 parts of carbon black (trademark: "Mogul L," manufactured by Cabot Corporation) as the first pigment;

19.5 parts of C.I. Pigment Brown 25 (trademark: "PV Fast Brown HFR," manufactured by Clariant Japan K.K.) as the second pigment;

9.75 parts of nigrosine (trademark: "TH-827" manufactured by Orient Chemical Industries Col, Ltd.) as the third pigment;

1.95 parts of C.I. Pigment Blue 15:3 (phthalocyanine blue pigment) (trademark: "Fastogen Blue GNPT," manufacture by DIC) as the fourth pigment;

4.55 parts of C.I. Pigment Yellow 180 (trademark: "Toner Yellow HG," manufactured by Clariant Japan K.K.) as the fifth pigment;

7.8 parts of pigment dispersant (trademark: "Ajisper PB-822," manufactured by Ajinomoto Fine-Techno Co., Inc.); and 6.0 parts of N-vinylpyrrolidone/alkylene copolymer (trademark: "Antaron V-216," manufactured by GAF/ISP Chemicals) as the toner dispersant. The average particle size of the toner particles was approximately 2.3 μm as well. In addition, the viscosity of the liquid developer was 31 mPa·s.

<Evaluation>

<Method for Measuring Molecular Weight>

The number-average molecular weight (Mn) of the crystalline polyester resin was measured by means of GPC (Gel Permeation Chromatography). The conditions for measurement were as follows.

Detector: RI (refractive index) detector

Column: Shodex KF-404HQ (trademark, manufactured by Showa Denko K.K.)+Shodex KF-402HQ (trademark, manufactured by Showa Denko K.K.)

Solvent: tetrahydrofuran

Flow rate: 0.4 ml/min

Calibration curve: standard polystyrene

<Measurement of Acid Value>

The acid value of the crystalline polyester resin was measured under the conditions defined by JIS K5400.

<Evaluation of Image Density>

An image forming apparatus shown in FIG. 1 was used to form a monochrome solid pattern (10 cm×10 cm, the amount of adhered toner particles: 1.5 g/m$^2$) of each of respective liquid developers of the Examples and Comparative Examples on a recording medium (coated paper), and then it was fixed with a heat roller (170° C.×nip time 30 msec).

After this, the image density of a black solid portion in the fixed image obtained as described above was measured with a reflection densitometer "X-Rite model 404" (trademark, manufactured by X-Rite, Inc.), and the image density was ranked based on the following three levels.

A: image density of 1.7 or more

B: image density of 1.6 or more and less than 1.7

C: image density of less than 1.6

A larger numerical value of the image density represents a higher image density. The results are shown in Table 2.

<Evaluation of Transfer Quality>

The image forming apparatus shown in FIG. 1 was used to form a monochrome solid pattern of each of respective liquid developers of the Examples and Comparative Examples on coated paper in a similar manner to the above-described one. Here, the amount of toner particles on an intermediate transfer unit before a transfer process is indicated by X g/m$^2$, and the amount of toner particles remaining on the intermediate transfer unit after the transfer process is indicated by Y g/m$^2$. Regarding the amount of toner particles on the intermediate transfer unit before the transfer process and that after the transfer process, the weight of the toner particles was measured after the developer was returned and the insulating liquid was dried. A transfer efficiency=((X−Y)/X) of 0.9 or more was ranked "A," a transfer efficiency of 0.8 or more and less than 0.9 was ranked "B" and a transfer efficiency of less than 0.8 was ranked "C." A higher numerical value of ((X−Y)/X) represents a higher transfer quality (namely the problem of transfer failure is alleviated). The results are shown in Table 2 below.

<Evaluation of Hue>

The image forming apparatus in FIG. 1 was used to form a monochrome solid pattern of each of respective liquid developers of the Examples and Comparative Examples on coated paper in a similar manner to the above described one.

The hue of this monochrome solid pattern was evaluated by means of a chroma meter (trademark: "CM-3700d," manufactured by Konica Minolta, Inc.). Specifically, a color difference ΔE of this monochrome solid pattern with respect to the sheet-fed offset printing color standards Japan Color for Color Reproduction Printing 2001 chart (paper type: coated paper, type: black-dot area ratio 100% portion) was determined. The color difference ΔE is defined as the square root of the sum of respective squares of respective differences in L* axis value, a* axis value, and b* axis value in the uniform color space of the L*a*b* color system defined under JIS Z 8729.

Then, a color difference ΔE of less than 3 was ranked "A," a color difference ΔE of 3 or more and less than 6 was ranked "B" and a color difference ΔE of 6 or more was ranked "C." A smaller color difference ΔE represents a more excellent hue. The results are shown in Table 2 below.

<Evaluation of Fixation Strength>

The image forming apparatus in FIG. 1 was used to form a monochrome solid pattern of each of respective liquid developers of the Examples and Comparative Examples on coated paper in a similar manner to the above described one.

After this, a rubber eraser (trademark: sand rubber eraser "LION 26111" manufactured by Lion Office Products Corp.) was rubbed twice against the above monochrome solid pattern with a press load of 1 kgf, and the ratio of remaining image density was measured with a reflection densitometer "X-Rite model 404" (trademark, manufactured by X-Rite, Inc.), and the fixation strength was ranked based on the following three levels.

A: image density remaining ratio of 90% or more

B: image density remaining ratio of 80% or more and less than 90%

C: image density remaining ratio of less than 80%

A higher image density remaining ratio represents a more excellent image fixation strength. The results are shown in Table 2.

The process conditions and an outline of the process of the image forming apparatus are as follows.

<Process Conditions>

System speed: 40 cm/s

Photoconductor: negatively charged OPC

Charge potential: −700 V

Development voltage (voltage applied to development roller): −450 V

Primary transfer voltage (voltage applied to transfer roller): +600 V

Secondary transfer voltage: +1200 V

Pre-development corona CHG: appropriately adjusted in a range of −3 to 5 kV of voltage applied to needle <Outline of Process>

FIG. 1 is a schematic conceptual diagram of an electrophotographic image forming apparatus 1. A liquid developer 2 is first scraped by a restriction blade 4 so that a thin layer of liquid developer 2 is formed on a development roller 3. After this, at a nip between development roller 3 and a photoconductor 5, toner particles are moved onto photoconductor 5 to form a toner image on photoconductor 5.

Then, at a nip between photoconductor 5 and an intermediate transfer unit 6, toner particles are moved to form a toner image on intermediate transfer unit 6. Subsequently, toner is superimposed one after another on intermediate transfer unit 6 to form an image on a recording medium 10. Then, the image on recording medium 10 is fixed by means of a heat roller 11.

It should be noted that image forming apparatus 1 also includes a cleaning blade 7, a charging device 8, and a backup roller 9, in addition to the above-described components.

TABLE 2

| | rank of image density | rank of hue | rank of transfer quality | rank of fixation strength |
|---|---|---|---|---|
| Example 1 | A | A | A | A |
| Example 2 | A | B | A | A |
| Example 3 | A | A | A | A |
| Example 4 | A | A | A | A |
| Example 5 | A | A | A | A |
| Example 6 | A | A | A | A |
| Example 7 | B | B | A | A |
| Example 8 | A | A | B | A |
| Example 9 | B | A | B | A |
| Example 10 | A | A | A | B |
| Example 11 | A | A | B | B |
| Example 12 | A | B | A | A |
| Example 13 | B | B | A | A |
| Example 14 | A | A | B | B |
| Example 15 | A | A | A | A |

TABLE 2-continued

| | rank of image density | rank of hue | rank of transfer quality | rank of fixation strength |
|---|---|---|---|---|
| Example 16 | B | A | A | A |
| Example 17 | A | A | B | B |
| Comparative Example 1 | A | A | C | A |
| Comparative Example 2 | A | B | B | C |
| Comparative Example 3 | A | B | C | C |
| Comparative Example 4 | B | C | B | B |
| Comparative Example 5 | C | A | A | A |
| Comparative Example 6 | A | C | C | C |

It has been confirmed, as clearly seen from Table 2, the liquid developers of the Examples are superior to the liquid developers of the Comparative Examples in terms of the image density and the hue, provide a good transfer quality (namely the problem of transfer failure is prevented), and are excellent in fixation strength.

Namely, the liquid developers of the present Examples have the excellent effects that they satisfy an adequate image density and a proper hue and prevent the problem of transfer failure regardless of use of a crystalline resin as the resin included in toner particles, and are also excellent in fixation strength.

The pigment included in the liquid developer of Comparative Example 1 was only carbon black, namely first pigment, and therefore, this liquid developer exhibited an inferior transfer quality while satisfying an adequate image density, a proper hue, and an adequate fixation strength. As to Comparative Example 2 including only carbon black and the third pigment, an adequate image density, a proper hue, and a good transfer quality were satisfied; however, the fixation strength was inferior. As to Comparative Example 3 including only carbon black and the second pigment, an adequate image density and a proper hue were satisfied; however, the transfer quality and the fixation strength were inferior. As to Comparative Example 4 including carbon black as well as the third and fourth pigments, an image density, a transfer quality, and a fixation strength were satisfied to a certain extent; however, the hue was inferior. The above comparative experiment has proved the effects of use of the first pigment, the second pigment, and the third pigment in combination by the present invention.

Moreover, Comparative Example 5 had an inferior image density due to a smaller total amount of the pigments in the toner particles. Comparative Example 6 was inferior in terms of the transfer quality, the fixation strength, and the hue due to its excessively large total amount of the pigments in the toner particles. It has accordingly been proved that the total amount of the pigments in the toner particles of the present invention is proper.

As to each of the evaluated items as described above, liquid developers ranked "A" or "B" are good enough for practical use.

While the description of the embodiments and examples of the present invention has been given above, it has originally been intended to appropriately combine features of the above embodiments and examples.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer including toner particles and an insulating liquid, said toner particles including a resin and a pigment, said resin including a crystalline resin, said pigment including a first pigment, a second pigment, and a third pigment, said first pigment being carbon black, said second pigment being C.I. Pigment Brown 23 and/or C.I. Pigment Brown 25, said third pigment being nigrosine, and 20 to 60% by mass of said pigment being included relative to said toner particles.

2. The liquid developer according to claim 1, wherein said pigment further includes a fourth pigment and/or a fifth pigment, said fourth pigment is C.I. Pigment Blue 15:3 and/or C.I. Pigment Blue 15:4, said fifth pigment is at least one type of yellow pigment selected from the group consisting of C.I. Pigment Yellow 74, C.I. Pigment Yellow 155, C.I. Pigment Yellow 180, and C.I. Pigment Yellow 185, and 20 to 60% by mass of said pigment is included relative to said toner particles.

3. The liquid developer according to claim 2, wherein 30 to 50% by mass of said first pigment is included relative to a total amount of said pigment, 30 to 50% by mass of said second pigment is included relative to the total amount of said pigment, and 15 to 30% by mass of said third pigment is included relative to the total amount of said pigment.

4. The liquid developer according to claim 1, wherein 30 to 50% by mass of said first pigment is included relative to a total amount of said pigment, 30 to 50% by mass of said second pigment is included relative to the total amount of said pigment, and 15 to 30% by mass of said third pigment is included relative to the total amount of said pigment.

* * * * *